US007204723B2

(12) United States Patent
Sun

(10) Patent No.: US 7,204,723 B2
(45) Date of Patent: Apr. 17, 2007

(54) UNIVERSAL SERIAL BUS CONNECTOR

(75) Inventor: Zheng-Heng Sun, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/344,460

(22) Filed: Jan. 30, 2006

(65) Prior Publication Data

US 2007/0004280 A1 Jan. 4, 2007

(30) Foreign Application Priority Data

Jun. 30, 2005 (CN) ..... 2005 2 0060925

(51) Int. Cl.
*H01R 13/502* (2006.01)

(52) U.S. Cl. ..... 439/701

(58) Field of Classification Search ..... 439/701, 439/752.5, 708, 660

See application file for complete search history.

(56) References Cited

U.S. PATENT DOCUMENTS 5,941,733 A 8/1999 Lai
6,466,437 B1 * 10/2002 Sakuragi et al. ..... 361/686
6,685,508 B2 2/2004 Zhu et al.
6,726,509 B2 * 4/2004 Milan ..... 439/752.5
6,902,432 B2 * 6/2005 Morikawa et al. ..... 439/607
2002/0193015 A1 * 12/2002 Milan ..... 439/752.5
2006/0028803 A1 * 2/2006 Pocrass ..... 361/686
2006/0149895 A1 * 7/2006 Pocrass ..... 711/103

* cited by examiner

*Primary Examiner*—Tulsidas C. Patel
*Assistant Examiner*—Phuongchi Nguyen
(74) *Attorney, Agent, or Firm*—Morris Manning & Martin LLP; Tim Tingkang Xia, Esq.

(57) ABSTRACT

A Universal Serial Bus (USB) connector includes a main body, a plug with four signal pins, a plug module, and a cable. The plug is formed in the plug module. The plug module is mounted to the main body. The cable is linked to the main body and electronically connected to the signal pins of the plug. It is simple and economical to replace any components of the USB connector expediently.

9 Claims, 5 Drawing Sheets

UNIVERSAL SERIAL BUS CONNECTOR

BACKGROUND OF THE INVENTION

1. Field of the Invention

The present invention relates to an electric connector, and particularly to a Universal Serial Bus (USB) connector.

2. General Background

To facilitate the linking of various external peripheral devices with different system terminals, four major international companies (including Compaq, Intel, Microsoft and NEC) have developed the USB interface in 1998. Ever since the Microsoft Windows 98 operating system started to provide built-in program for driving USB interface peripheral devices, the use of these peripheral products is facilitated. As a result, the applications of USB products have been expanding gradually.

FIG. 5 discloses a conventional USB connector. The USB connector 10 includes a main body 12, a plug 14 and a cable 16. The plug 14 includes four signal pins 14*a*, 14*b*, 14*c* and 14*d*. However, the USB connector 10 as shown in FIG. 5 is an integrative USB connector. When the main body 12 or is the plug 14 of the USB connector 10 is unexpectedly damaged, the USB connector 10 must be replaced entirely.

What is needed is a USB connector that can divide into some pieces, and replace expediently.

SUMMARY

An exemplary USB connector includes a main body, a plug with four signal pins, a plug module, and a cable. The plug is formed in, the plug module. The plug module is mounted to the main body. The cable is linked to the main body and electronically connected to the signal pins of the plug.

It is simple and economical to replace any components of the USB connector expediently.

Other advantages and novel features will become more apparent from the following detailed description when taken in conjunction with the accompanying drawings, in which:

DETAILED DESCRIPTION OF THE EMBODIMENT

Figure 1:
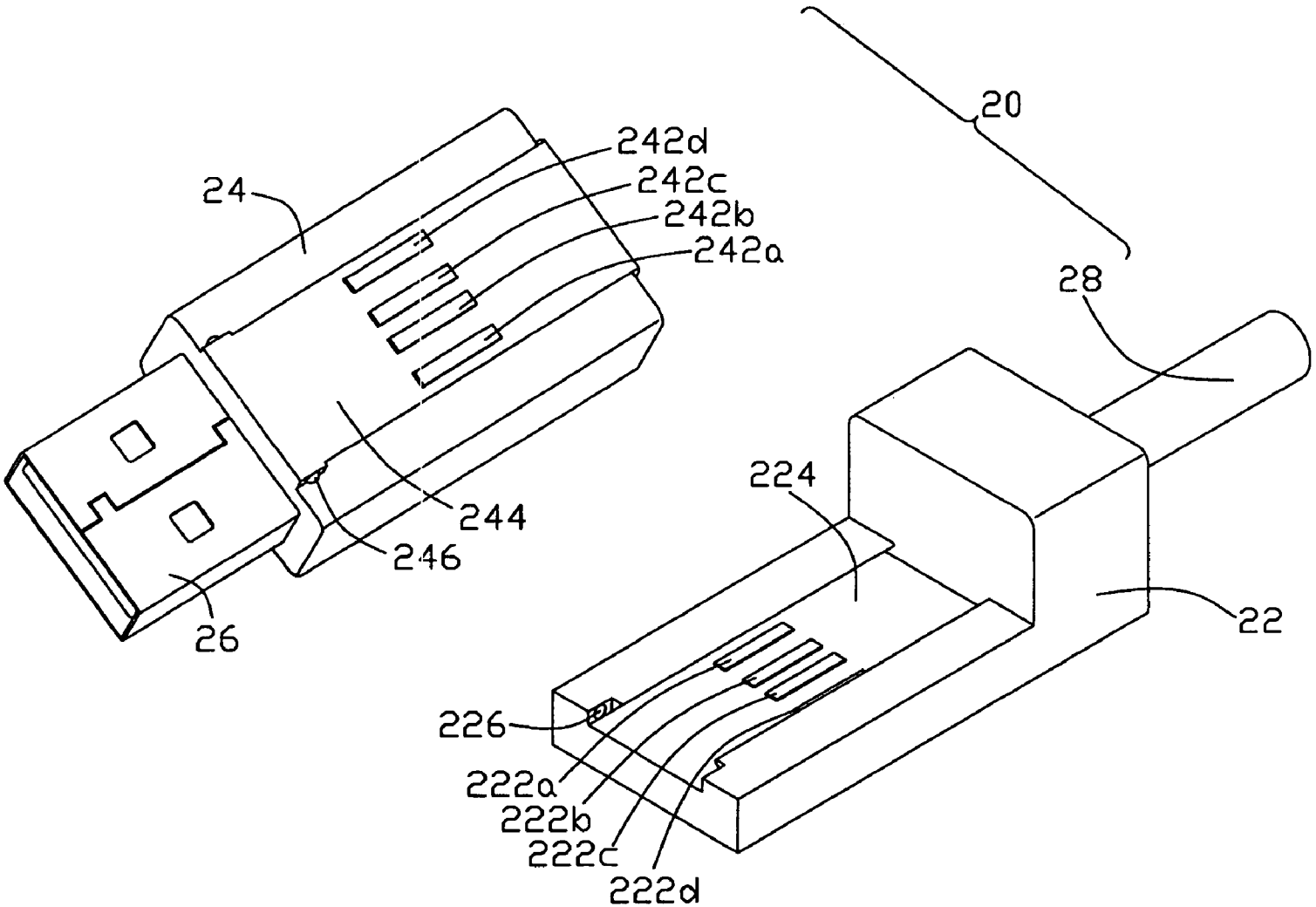
FIG. 1 is an exploded perspective view of a USB connector in accordance with a first preferred embodiment of the present invention.
Figure 2:
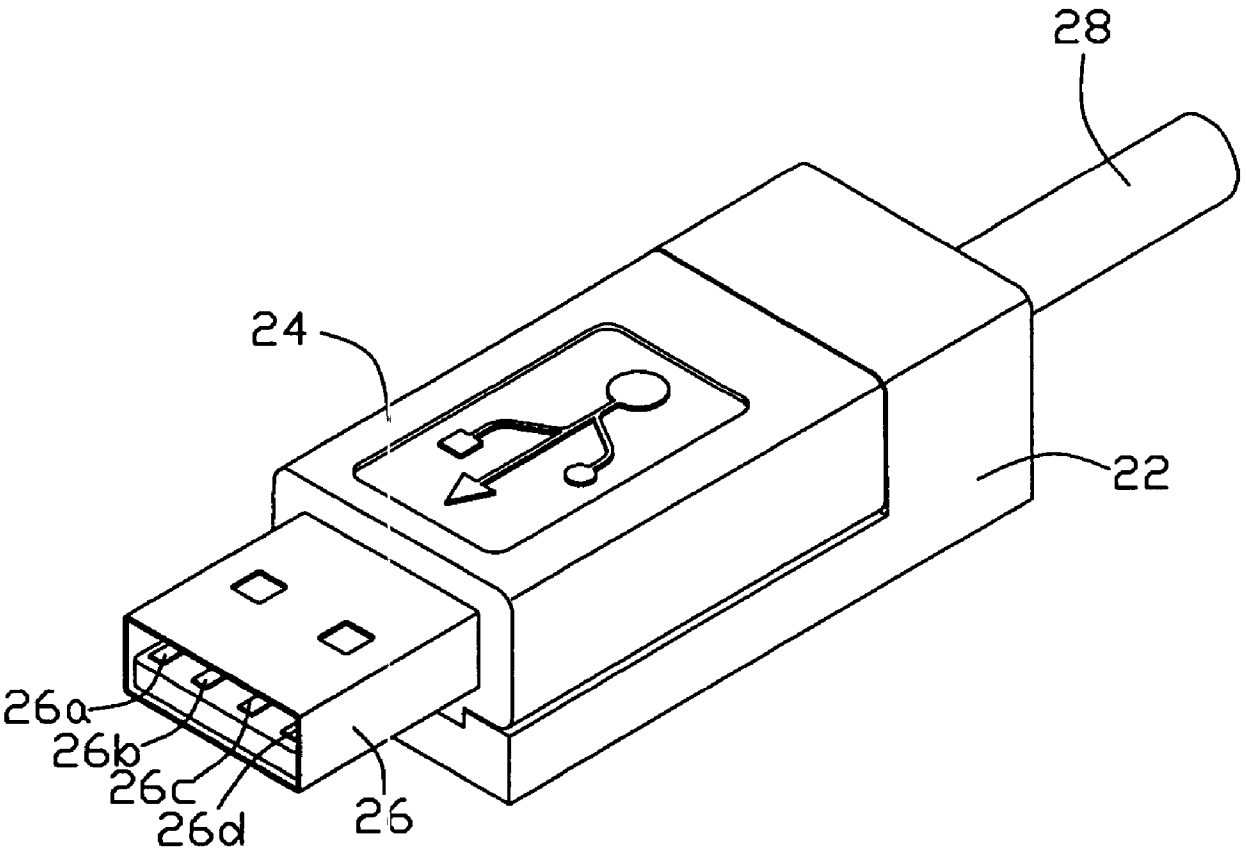
FIG. 2 is an assembled view of FIG. 1.

Referring to FIG. 1 and FIG. 2, a connector assembly in accordance with the present invention is applicable to a plug connector, a receptacle connector and/or a combination of the plug and receptacle connectors. Using a plug connector as an exemplary embodiment, a USB connector 20 includes a main body 22, a plug 26 with four signal pins 26*a*, 26*b*, 26*c* and 26*d* used as a connective interface for the USB connector 20, a plug module 24 and a cable 28 used as a connective means to provide further electrical connection for the USB connector 20. The main body 22 includes a dove-tail notch 224 with four signal pads 222*a*, 222*b*, 222*c* and 222*d*. The main body 22 further includes a pair of holes 226 at two opposite sides of the dove-tail notch 224. The cable 28 is linked to the main body 22 and connected to the signal pads 222*a*, 222*b*, 222*c* and 222*d* on a bottom surface thereof. The plug 26 formed in the plug module 24. The plug module 24 includes a dove-tail jut 244 with four signal pads 242*a*, 242*b*, 242*c* and 242*d*. The plug module 24 further includes a pair of knobs 246 at two opposite sides of the dove-tail jut 244. The signal pads 242*a*, 242*b*, 242*c* and 242*d* of the plug module 24 are connected with the signal pins 26*a*, 26*b*, 26*c* and 26*d* of the plug 26 respectively. The signals that the pins and pads transmit are shown in the following table:

| PIN | SIGNAL |
|---|---|
| a | VCC(+5 V) |
| b | D− |
| c | D+ |
| d | Ground |

When the plug module 24 is mounted to the main body 22 via the dove-tail jut 244 mating with the dove-tail notch 224, the knobs 246 of the plug module 24 are locked with the holes 226 of the main body 22. Thereby, the signal pads 222*a*, 222*b*, 222*c* and 222*d* are contacted with the signal pads 242*a*, 242*b*, 242*c* and 242*d* respectively.

Figure 3:
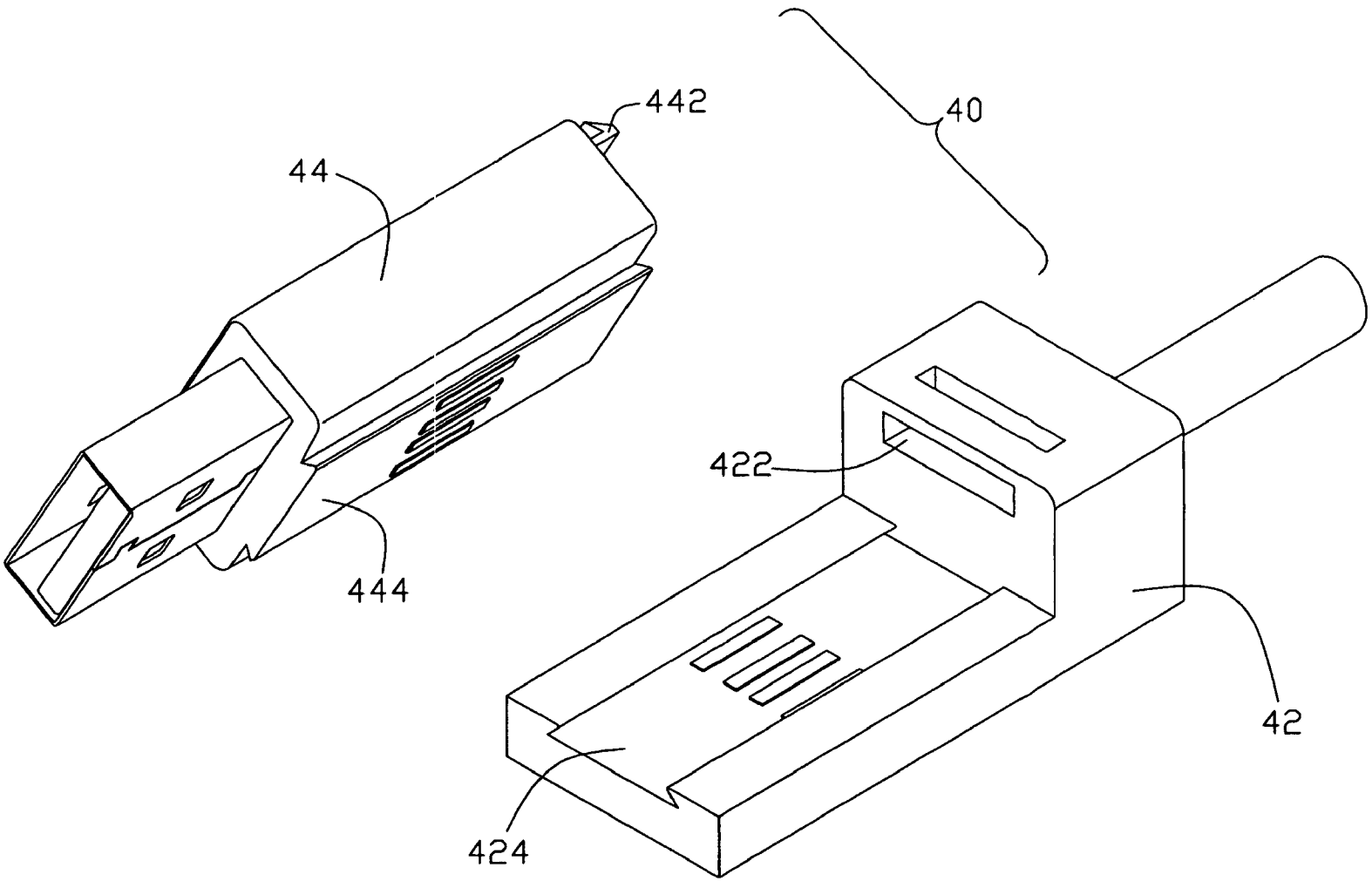
FIG. 3 is an exploded perspective view of a USB connector in accordance with a second preferred embodiment of the present invention.
Figure 4:
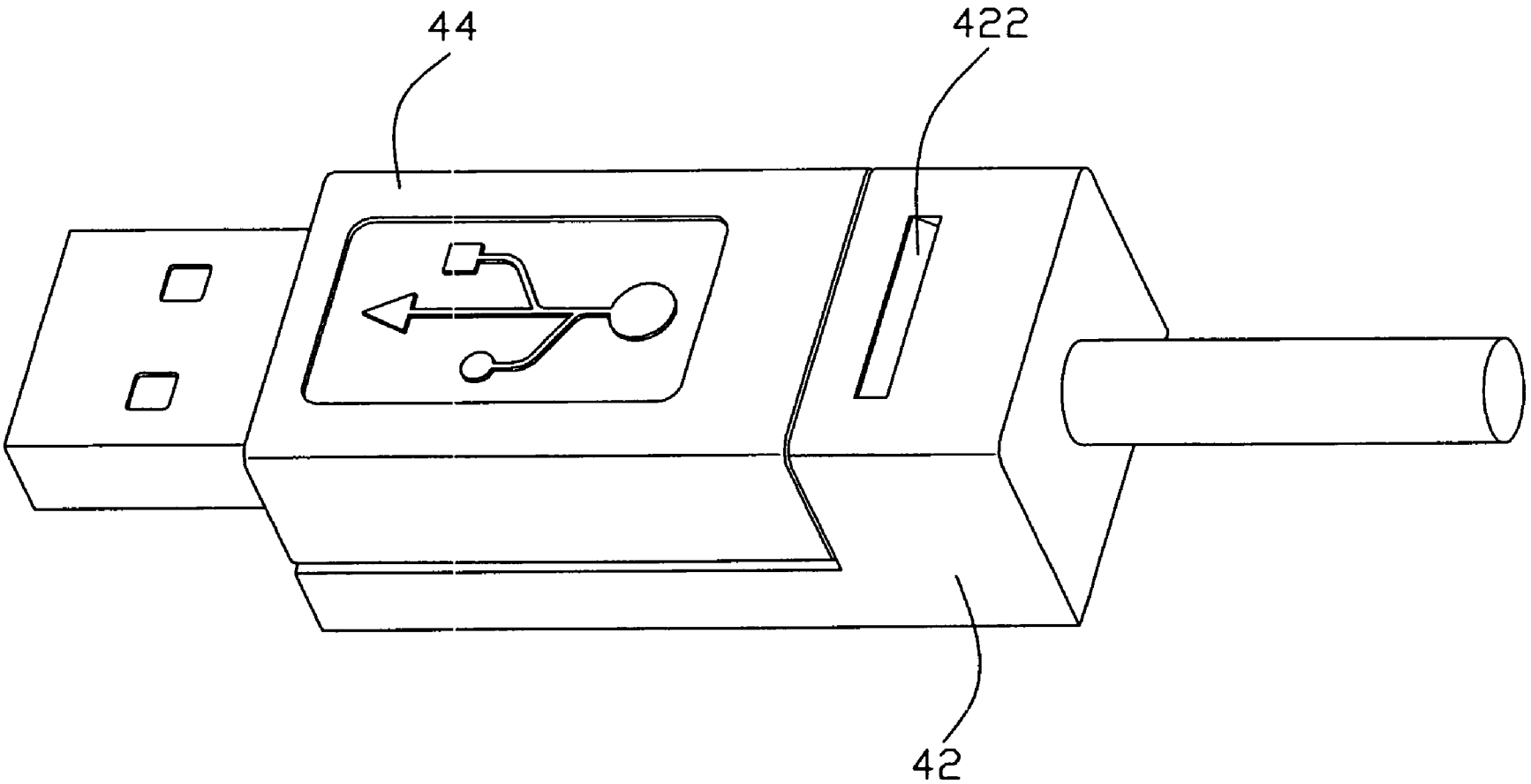
FIG. 4 is an assembled view of FIG. 3.
Figure 5:
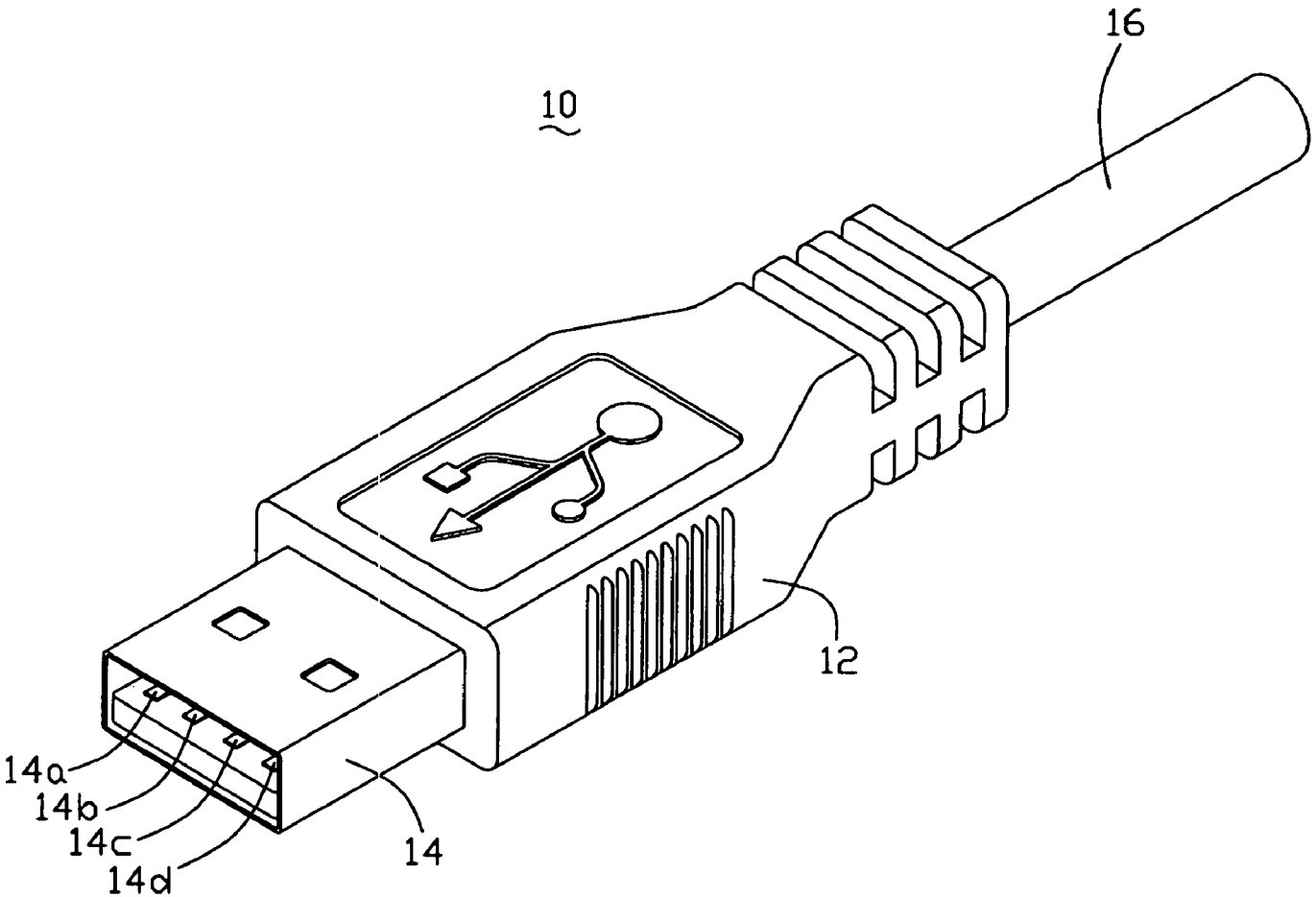
FIG. 5 (RELATED ART)
FIG. 5 is an isometric view of a conventional USB connector.

FIG. 3 and FIG. 4 show a USB connector 40 according to a second preferred embodiment of the present invention. As illustrated in FIG. 3, the USB connector 40 includes a main body 42 and a plug module 44 with a USB plug. The main body 42 includes an aperture 422 and a dove-tail notch 424 with four signal pads. The plug module 44 includes a hook 442 and a dove-tail jut 444 with four signal pads.

When the plug module 44 is mounted to the main body 42 via the dove-tail jut 444 mating with the dove-tail notch 424, the hook 442 of the plug module 44 is locked with the aperture 422 of the main body 42.

It is believed that the USB connectors 20 and 40 can replace the plug module 24 and 44 or the main bodies 22 and 42 expediently.

It is to be understood, however, that even though numerous characteristics and advantages of the present embodiments have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Universal Serial Bus (USB) connector comprising:

a main body comprising a notch with a plurality of signal pads therein;

a plug module detachably mounted to the main body;

a plug formed in the plug module comprising a plurality of signal pins; and a cable linking to the main body and electrically connected to the signal pads of the main body;

wherein the plug module comprises a jut with another plurality of signal pads thereon, the plug module is mounted to the main body via the jut of the plug module mating with the notch of the main body, the signal pads of the notch are electrically connected to the signal pads of the jut respectively, the signal pins of the plug are electrically connected to the signal pads of the plug module respectively, the plug module is locked with the main body by matching a pair of knobs at two opposite sides of the jut with a pair of holes at two opposite sides of the notch.

2. The USB connector as claimed in claim 1, wherein the notch and the jut are dove-tail shape.

3. The USB connector as claimed in claim 1, wherein the engaging means comprises a hook on the plug module, and an aperture in the main body.

4. A Universal Serial Bus (USB) connector comprising:

an L-shaped main body connected with a cable defining a recess, and a dove-tail notch in a bottom of the recess with a plurality of signal pads therein; and a replaceable plug module detachably and slidably mounted to the main body via a dovetail jut formed on a bottom surface of the plug module received in the notch of the main body, the plug module comprising a plug formed therein, and a plurality of signal pads formed thereon to be electronically connected to the cable;

wherein the plug module is locked with the main body via a pair of knobs at two opposite sides of the jut matching with a pair of holes at two opposite sides of the notch.

5. The USB connector as claimed in claim 4, wherein a plurality of signal pads is formed on a bottom of the notch to be electronically connected to the signal pads of the plug module, and the cable is electronically connected to the signal pads of the notch.

6. The USB connector as claimed in claim 4, wherein the plug module is locked with the main body via a hook on the plug module and an aperture in the main body.

7. A Universal Serial Bus (USB) connector comprising:

an L-shaped main body comprising a horizontal portion and a vertical portion extending upright from the horizontal portion, a notch defined in an upper surface of the horizontal portion with a plurality of signal pads therein, an aperture defined in an inner surface of the vertical portion adjacent to the horizontal portion; and a replaceable plug module detachably mounted to the main body via a jut formed on a bottom surface of the plug module being engagingly received in the notch, the plug module comprising a plug formed therein, a plurality of signal pads formed on the jut to be electronically connected to the signal pads of the main body respectively, and a hook extending from an upright end surface facing the inner surface of the vertical portion of the main body;

wherein the plug module is locked with the main body via the hook of the plug module engaging in the aperture of the main body.

8. The USB connector as claimed in claim 7, wherein the notch and the jut are dove-tail shape.

9. The USB connector as claimed in claim 7, wherein the plug module is further locked with the main body via a pair of knobs at two opposite sides of the jut and a pair of holes at two opposite sides of the notch.

* * * * *